United States Patent [19]

Simmons

[11] Patent Number: 4,987,926

[45] Date of Patent: Jan. 29, 1991

[54] FAUCET USING A CISTERN PUMP HANDLE AND A WATER MIXING VALVE

[76] Inventor: William L. Simmons, 36353 W. Lyman Rd., Farmington Hills, Mich. 48331

[21] Appl. No.: 475,227

[22] Filed: Feb. 5, 1990

[51] Int. Cl.[5] ..... F16K 27/06; F16K 31/52

[52] U.S. Cl. ..... 137/625.4; 251/155; 251/232; 417/236

[58] Field of Search ..... 251/155, 156, 232; 417/236; 137/625.4

[56] References Cited

U.S. PATENT DOCUMENTS 934,082 9/1909 Martin ..... 251/232 X

*Primary Examiner*—Arnold Rosenthal

*Attorney, Agent, or Firm*—Charles W. Chandler

[57] ABSTRACT

A faucet having a cistern-type pump body with a handle mounted on its upper end, and linkage connected to a rotary mixing valve mounted beneath the pump body such that when the handle is raised, a mixture of hot and cold water is delivered through a conduit mounted in the pump spout.

6 Claims, 3 Drawing Sheets

FAUCET USING A CISTERN PUMP HANDLE AND A WATER MIXING VALVE

BACKGROUND OF THE INVENTION

This invention is related to water faucets, and more particularly to a faucet having a cistern-type pump body supporting an elongated handle for actuating a mixing valve to deliver water through a spout carried on the pump body.

Cistern-type pumps are commonly used where city water is unavailable. Such a pump typically has an elongated, upright hollow body with a spout spaced above the pump's base. A handle, pivotally mounted on the upper end of the body, is connected by linkage means to a pumping mechanism for drawing water from a reservoir as the handle is swung in an up-and-down motion.

To my knowledge such a pump body is not used as a faucet for delivering city water from a pressurized source.

SUMMARY OF THE INVENTION

The broad purpose of the present invention is to provide a faucet using a cistern-type pump body for delivering pressurized water pressurized by means independent of the pump handle motion. The conventional handle is pivotally mounted on the upper end of the pump body. A conventional, rotary-type mixing valve is mounted below the pump base. Such a valve is commonly used for mixing hot and cold water in proportions depending upon the position of an actuating member, and then delivering the mixture through an outlet. Such valves are commonly used with single handle faucets.

A linkage is connected to the pump handle. An actuating member on the mixing valve is connected to the linkage such that when the outer end of the handle is swung in an arc, the valve is moved to a position defining the proportion of the hot and cold water mix.

The mixed water is delivered through a conduit from the outlet of the mixing valve. The conduit extends up through the pump body to the pump spout. An aerator, mounted on the outer end of the conduit, delivers the water to the user.

The invention is useful for either a household faucet or an outdoor "pump".

Still further objects and advantages of the invention will become readily apparent to those skilled in the art to which the invention pertains upon reference to the following detailed description.

DESCRIPTION OF THE DRAWINGS

The description refers to the accompanying drawings in which like reference characteristics refer to like parts throughout the several views, and in which.

DESCRIPTION OF THE PREFERRED EMBODIMENT

Figure 1:
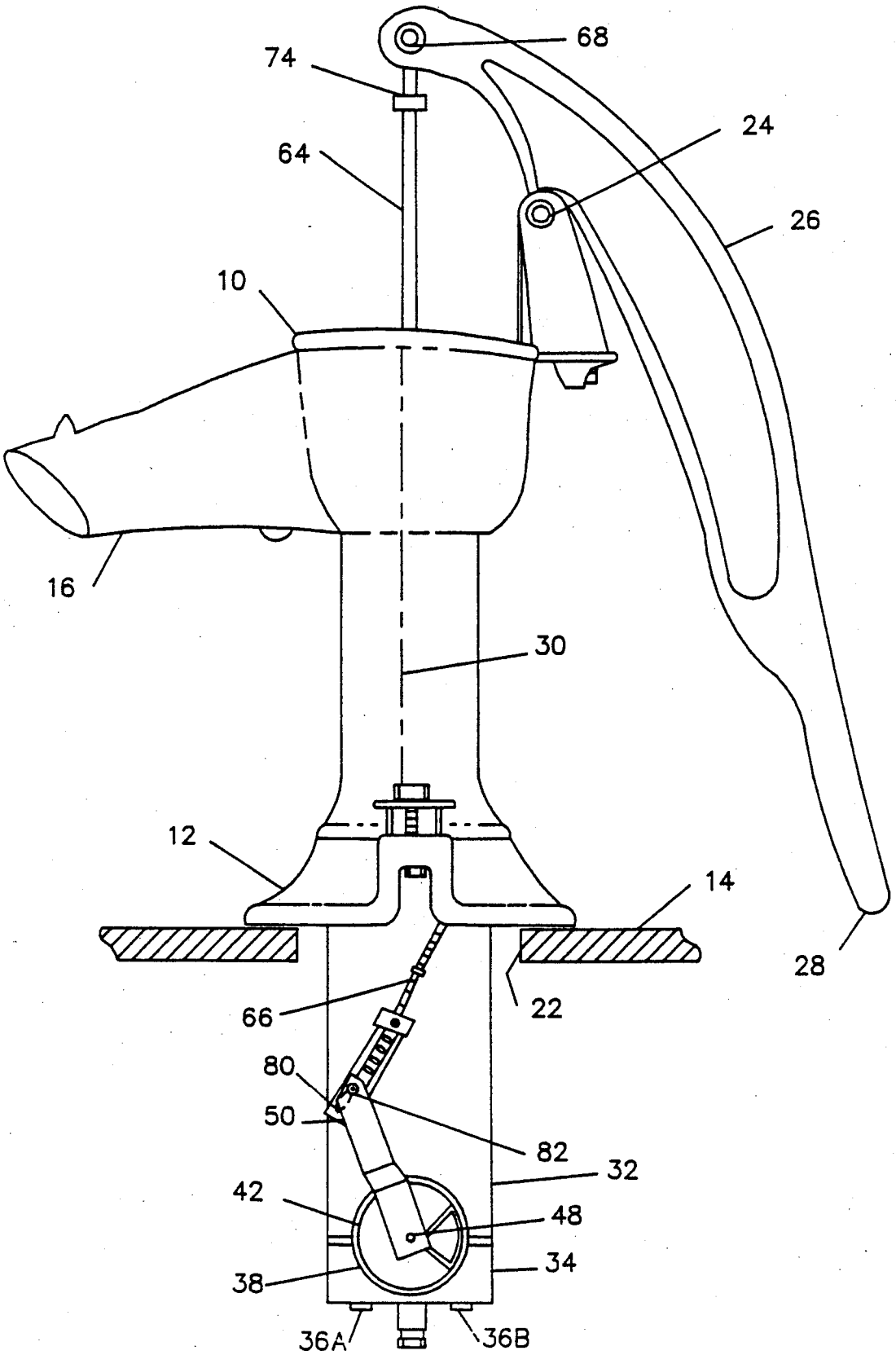
FIG. 1 is a view of a preferred faucet apparatus showing one side of the mixing valve.

Referring to the drawings, FIG. 1 illustrates an elongated cistern-type, multi-part pump body 10 which can take a variety of shapes. Such a body shape is usually seen on older pumps for drawing water from a well or cistern and is well known to those skilled in the art.

Pump body 10 has a base 12 for mounting on a supporting surface 14. The pump body has a spout 16 spaced above the base for delivering water. The base also has a bottom opening 20 mounted above an opening 22 in supporting surface 14.

Figure 5:
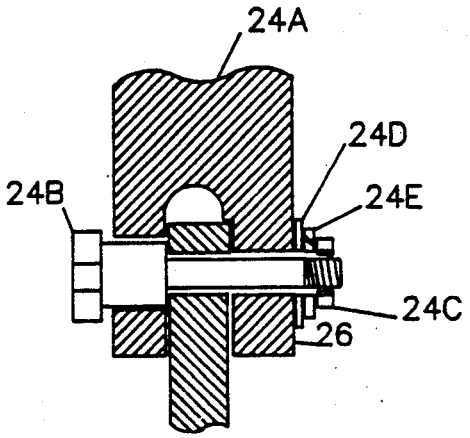
FIG. 5 is an enlarged view of the pump handle pivot means.

Pivot means 24 are mounted on the upper end of the pump body to pivotally support an elongated handle 26. Referring to FIG. 5, pivot means 24 includes a clevis 24A which is part of the pump body cover. A shoulder screw 24B fastens handle 26 to the clevis. A hexagonal adjusting nut 24C is threadably mounted on screw 24B. Plain washer 24D and lockwasher 24E are clamped between the nut and the clevis to form an adjustable spring-loaded handle pivot to achieve the function necessary to hold the handle in any desired position.

Handle 26 has an outer end 28 swingable in a plane disposed generally parallel to the longitudinal axis 30 of the pump body.

A block 32 is attached to and beneath the base of the pump body. A clamping support 34 is connected to block 32 by threaded fastener means 36A and 36B. Block 32 and support 34 collectively define opening 38.

Figure 2:
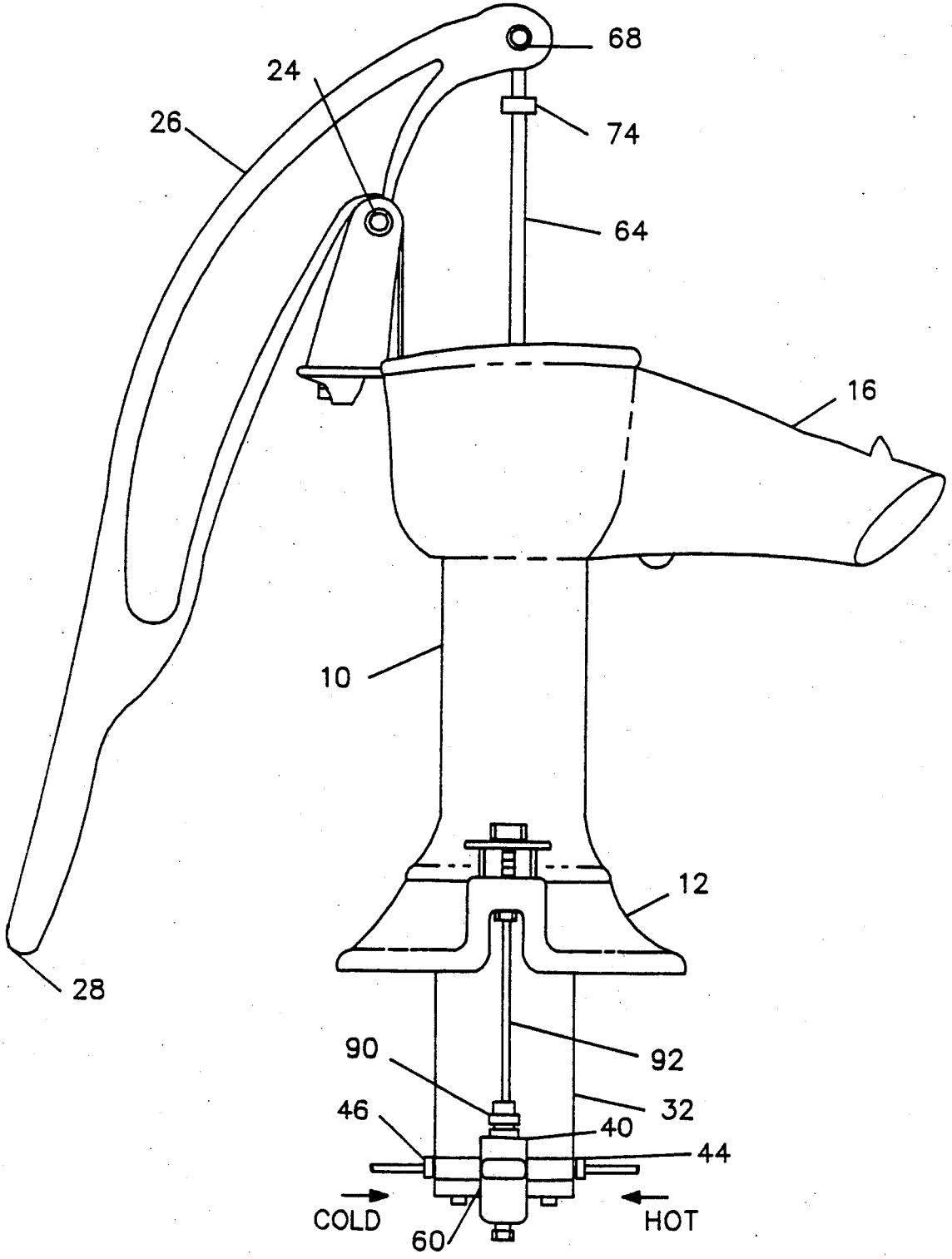
FIG. 2 is a view similar to FIG. 1, but showing the opposite side of the mixing valve.

A mixing valve 40 has a rotary actuator 42 clamped in opening 38. The mixing valve is mounted on one side of block 32, as shown in FIG. 2. Rotary actuator 42 extends beyond the opposite side of block 32, as shown in FIG. 1. The mixing valve is a conventional, commercially-available component having inlet opening means 44 on one side for receiving hot water, and a second inlet opening means 46 on the opposite side for receiving cold water, as illustrated in FIG. 2.

Figure 3:
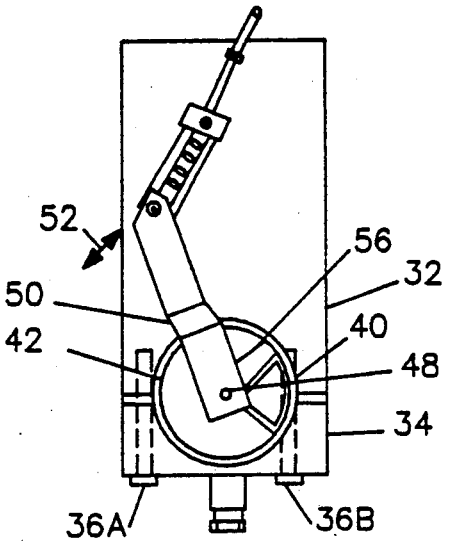
FIG. 3 is an enlarged view of the linkage connecting the mixing valve actuator lever.

Referring to FIG. 3, the actuator has a rotary valve shaft 48. A lever 50 has one end connected to shaft 48 so that the lever can be swung in an arc, generally illustrated at 52 in FIG. 3, a pair of extreme positions including a position in which the lever engages stop member 56.

The mixing valve has a body 60 in which the hot and cold water are mixed according to the position of the lever. In one extreme position, water passage through the mixing valve is blocked. As the lever is moved toward stop member 56, the mixture increases from a cold to a hot mixture, in a manner well known to those skilled in the art of single lever, mixing valves.

Figure 4:
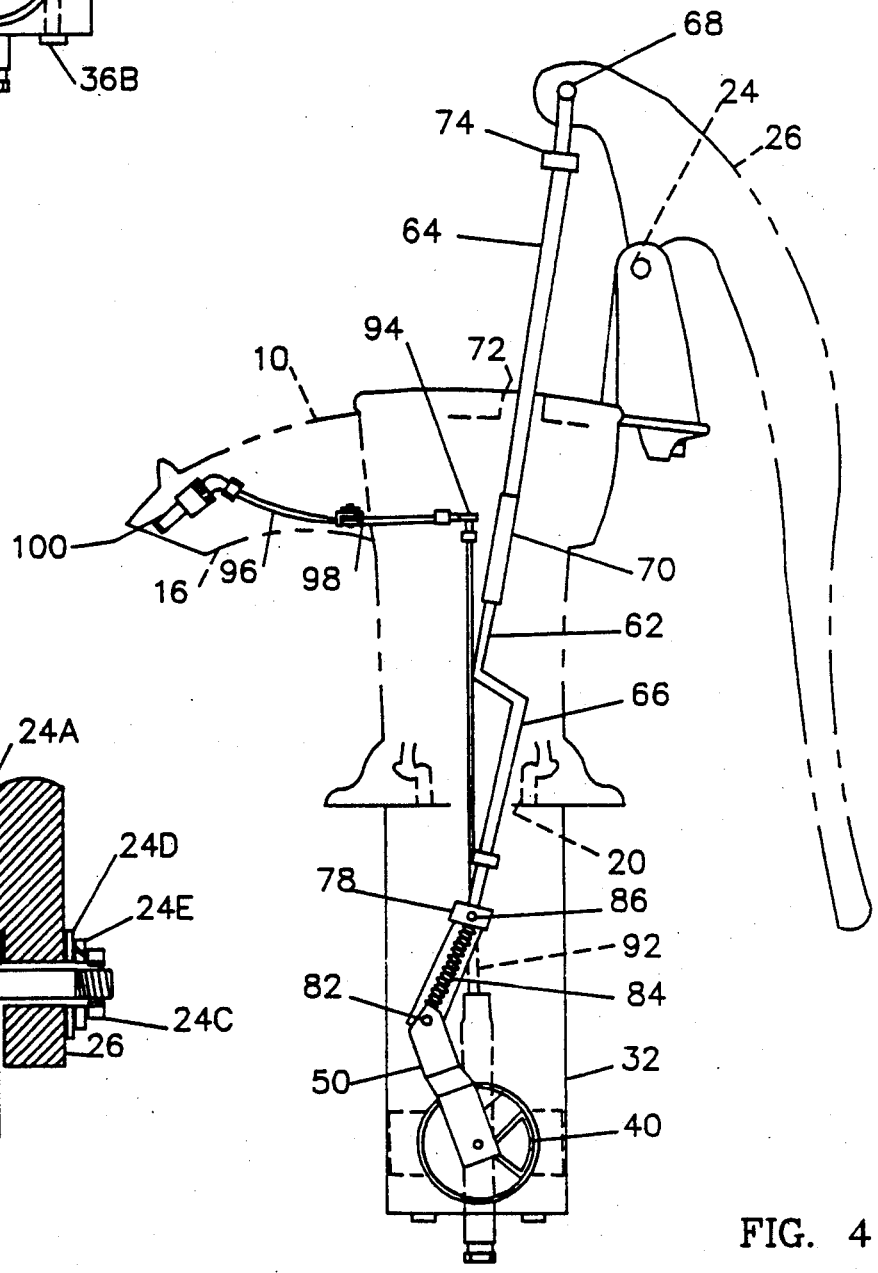
FIG. 4 is a view showing the linkage and conduit components mounted within the pump body.

Linkage means 62 connect handle 26 to lever 50. The linkage means include a pair of links 64 and 66. The upper end of link 64 is pivotally connected at 68 in an opening in handle 26, as illustrated in FIG. 4. The lower end of link 64 is threaded and connected to an internally threaded tubular connector 70. Link 66 is threaded along its length. Link 64 extends through an opening 72 in the upper end of the pump body means. A collar 74 is mounted on link 64. Link 66 is threadably connected to the lever end of connector 70.

As the outer end of the handle is raised, the opposite end of the handle is lowered toward the pump body. Its extreme position is defined by a position in which collar 74 abuts the upper end of the pump body to define the second extreme position of lever 50.

An elongated support 78 is threadably mounted on the lower end of link 66. The lower end of support 78 has a slot 80 (FIG. 1). A fastener 82, carried on lever 50, is mounted in the slot to connect the lever to support 78 in such a manner that as link 66 is lowered, it causes lever 50 to rotate in the counterclockwise direction as viewed in FIG. 4. As link 66 is raised, it rotates the lever in the clockwise direction.

A helical spring 84 is connected between a fastener 86 carried on support 78, and a fastener 82 carried on the lever to bias the lever toward the upper end of slot 80. The combined length of the links is chosen so that the lever never reaches a position in which the links are unable to apply a torque on valve shaft 48.

Referring to FIG. 2, the valve body has outlet means 90 for passing the water mixture. Referring to FIG. 4 a conduit 92 is connected to the outlet means 90. The upper end of conduit 92 is connected by a right angle connector 94 to a second conduit 96. Conduit 96 is connected to the interior of the pump body by a support 98. A conventional aerator 100 is mounted on the outer end of conduit 96 adjacent the spout opening to deliver water from spout 16.

In use, the valve body is connected to hot and cold water connections, as illustrated in FIG. 2. The linkage is connected to handle 26. Normally, the handle is in its lower-most position as illustrated in FIG. 4, and the mixing valve in its closed position. As the outer end of the handle is raised, the mixing valve is opened to deliver cold water. Further raising of the handle 26 delivers a mixture of hot and cold water through aerator 100. When the valve is fully raised, the mixture comprises mostly hot water.

The preferred faucet is suitable for a variety of cistern-type pumps of the type illustrated in FIG. 1 or it can be adapted to an antique type body.

Having described my invention, I claim:

1. A hand-operated water faucet apparatus, comprising:

an elongated cistern-type pump body means adapted to be supported in an upright position, said pump body means having an upper end, and a base with a lower opening;

an elongated handle;

pivot means mounted on the upper end of the pump body means and connected to the handle such that one end thereof is swingable in an arc disposed in a plane generally parallel to the longitudinal axis of the pump body means;

the pump body means having a spout projecting therefrom in a position spaced above the base;

valve means having an inlet adapted to be connected to a source of water under pressure, the valve means having an outlet for passing said pressurized water, the valve means including an actuator member moveable between first and second positions such that water passes from the inlet of the valve means to the outlet when the actuator member is in said first position, and water passage through the valve means is blocked when the actuator member is disposed in said second position;

linkage means connected between the handle and the actuator member for moving same; and conduit means having one end connected to the outlet of the valve means, and an opposite end disposed in the spout to pass water from the spout when the handle has been moved to actuate the valve means to pass water from said inlet to the outlet thereof.

2. A water faucet apparatus as defined in claim 1 in which the linkage means includes a link connected to the handle, and a lever connected to the actuator member, and means connecting the link to the lever such that as the link is moved in a direction generally parallel to the longitudinal axis of the pump body, the lever swings in an arc about the valve means to actuate same.

3. A water faucet apparatus as defined in claim 2, including a member mounted on the lower end of the link, said member having a slot, pin means carried by the lever and received in the slot, and bias means connected between the lever and said member for biasing the pin means toward one end of the slot as the handle is being swung toward an upper position.

4. A water faucet apparatus as defined in claim 1, in which the valve means is a mixing valve for receiving both hot and cold water through separate inlets and for mixing same and passing the mixture to the valve outlet.

5. A water faucet apparatus as defined in claim 1, in which the means is a rotary mixing valve.

6. A faucet apparatus as defined in claim 1, including aerator means mounted on the upper end of the conduit means and disposed in the pump body means spout.

* * * * *